US006366451B1

(12) United States Patent
Smock et al.

(10) Patent No.: US 6,366,451 B1
(45) Date of Patent: Apr. 2, 2002

(54) DISPLAY SCREEN ENCLOSURE

(76) Inventors: Franklin Smock, 3680 Lisa La., Plainfield, IN (US) 46168; Randall Shoemaker, 9630 Shoal Creek La., Brownsburg, IN (US) 46112

( * ) Notice: Subject to any disclaimer, the term of this patent is extended or adjusted under 35 U.S.C. 154(b) by 0 days.

(21) Appl. No.: 09/523,715

(22) Filed: Mar. 13, 2000

(51) Int. Cl.[7] ..... G06F 1/16; H04N 5/64; A47B 81/06

(52) U.S. Cl. ..... 361/681; 312/7.2; 248/918; 248/921; D14/138; 349/58

(58) Field of Search ..... 361/681, 682; 349/58; 312/223.1, 7.2, 223.2, 223.3; 248/917–924; D14/138; 348/837

(56) References Cited

U.S. PATENT DOCUMENTS 2,494,364 A * 1/1950 Shaw ..... 312/7.2
4,829,725 A * 5/1989 Gustaveson et al. ..... 312/7.2
5,096,271 A * 3/1992 Portman ..... 312/7.2
5,148,282 A * 9/1992 Sedighzadeh ..... 312/7.2
5,181,771 A * 1/1993 Robak et al. ..... 312/7.2
5,401,089 A * 3/1995 Imagki et al. ..... 312/7.2
5,459,893 A * 10/1995 Walters, III ..... 312/7.2
5,467,106 A * 11/1995 Salomon ..... 312/7.2
5,583,735 A * 12/1996 Pease et al. ..... 361/682
5,743,487 A * 4/1998 Rice ..... 312/7.2
5,946,055 A * 8/1999 Rosen ..... 312/7.2
6,125,030 A * 9/2000 Mola et al. ..... 361/681

* cited by examiner

*Primary Examiner*—Leo P. Picard
*Assistant Examiner*—Lisa Lea-Edmonds
(74) *Attorney, Agent, or Firm*—Daniel J. O'Connor

(57) ABSTRACT

A secure enclosure for a flat panel display screen which is positioned within a ceiling grid structure. An enclosing plenum includes operating means so that the display screen may be readily lowered to several different display angles. The apparatus and method may be applied to video or other display screens used, for example, in conference rooms. The overall system provides security for the expensive display screen and space saving when the screen is not in use.

5 Claims, 1 Drawing Sheet

DISPLAY SCREEN ENCLOSURE

BACKGROUND AND OBJECTS OF THE INVENTION

Figure 1:
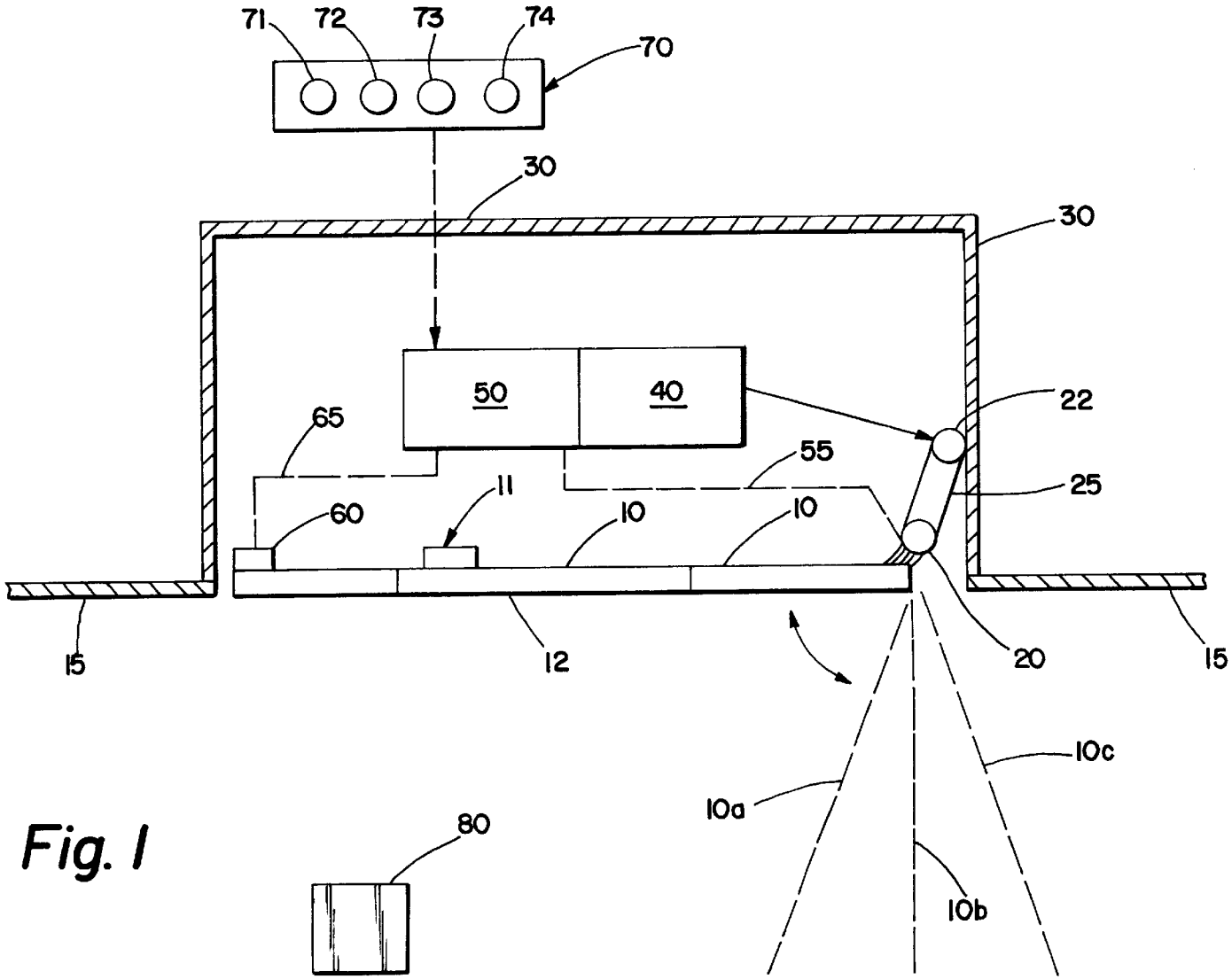

The present invention is generally related to the video display panel arts and, in particular, to a novel apparatus and method for enclosing and protecting display panels while allowing the panel to be easily moved to a display position.

The use of flat display panels or screens is widely known for such uses as conference rooms, airport information display, arena information display and many other applications.

The flat panel display screens are typically very costly and need to be protected and secured when not in use. Storage in a ceiling location would also be advantageous for space saving and aesthetic reasons when the display panel is not in use.

Accordingly, it is an object of the present invention to set forth a flat panel display screen which may be securely enclosed within a ceiling structure when not in use.

It is also an object of the invention to demonstrate a flat panel display screen which may be easily moved from a secure enclosed position to a display position by utilizing mechanical drive means and remote control operation.

It is a still further object of the invention to show a flat screen operating system which may be economically mass-produced for widespread commercial appeal.

The method of the invention allows display screen positioning at variable angles to account for optimal observation by viewers.

These and other objects and advantages of the invention will be apparent to those of skill in the art from the description which follows.

PRIOR ART PATENTS AND DESIGNS

The present invention is believed to be classified in U.S. Patent Office Class 359, Optics Systems and Operating Elements. The Subclasses most pertinent appear to be Subclasses 443 to 461 which include the more conventional roll-up screens of the prior art in contrast to the flat-screen design and operation of the present invention.

The present invention is believed to be clearly patentable over all known prior art systems and designs.

SUMMARY OF THE INVENTION

A flat panel display screen is mounted to a rotatable shaft which is driven by a chain and sprocket and gear motor configuration.

The gear motor is controlled electronically by means of a four-button remote switch. One of three display positions is selected by operation of the switch.

When an up button is pushed, the display screen is returned to a secure position within a plenum contained in a ceiling grid.

The drive shaft may include a tension spring to counterbalance the weight of the display screen. A limit switch shuts off power to the drive unit when the screen is returned to the up or secured position.

BRIEF DESCRIPTION OF THE DRAWING FIGURE

FIG. 1 shows a side schematic view of the operating elements and method of operation of the invention. The flat display screen is shown in its up and secured position in the ceiling plenum and the various lower possible positions are indicated.

DESCRIPTION OF A PREFERRED EMBODIMENT

Referring to FIG. 1, the flat display panel 10 is shown in its secured up position within a plenum 30.

The plenum 30 is formed as part of a ceiling grid assembly 15 and is above the ceiling grids 15.

The display panel 10 has a lower cover 12 which is designed to blend in with the ceiling grids 15 when the display panel is in the secured up position.

The display panel 10 is mounted on a rotatable shaft 20 which serves to turn the flat display screen 10 down into various display positions as indicated by numerals 10*a*, 10*b* and 10*c*.

The shaft 20 is turned via a chain and sprocket assembly indicated schematically by numerals 25 and 22.

Shaft 22 is turned by means of a gear motor 40 which is controlled by electronic control box 50. Input to the control box 50 is via a remote controller 70.

The remote controller 70 comprises a four button remote or wall switch having switches 71, 72, 73 and 74 as shown.

In operation, when switch 71 is activated, the control box 50 activates gear motor 40 to operate the chain and sprocket assembly 22, 25 and shaft 20 is turned counter-clockwise such that the flat display panel 10 is lowered to a first display position 10*a*.

In similar fashion, when 72 is activated, the display panel 10 is moved to a display position 10*b*. When switch 73 is activated, the display panel 10 is moved to a third display position 10*c*.

The various display positions 10*a*, 10*b* and 10*c* are important so that a viewing audience, indicated at numeral 80, may optimally see the displayed information depending upon the particular location of the viewers.

The various positions of screen 10 are controlled by a sensor of shaft 20 position which is fed back to the electronic control box 50 via line 55 as shown in the drawing figure.

To move the flat screen 10 back to an up and secured position within the plenum 30, switch 74 is activated and shaft 20 is rotated clockwise to move the screen 10 upward by means of the control box 50 and the system previously described.

A limit switch 60 may be employed in the system to shut off power to the drive means via line 65 when the panel 10 is in the up and secured position.

The display panel 10 may also include at least one speaker element 11 as indicated.

The materials used in the invention, for example in the plenum 30 or chain and sprocket assemblies, may comprise metals, plastics or other suitable materials known in the mechanical arts.

The flat panel screen 10 may comprise any type of video or digital information display and may comprise plasma display panels. The electronic control means 50 is of a type known in the control arts but not heretofore shown in combination with the elements of the invention.

From the above description, it will be apparent to those of skill in the art that the invention method and apparatus has numerous advantages.

The flat display screen is provided with a secure in-ceiling protective location when needed. The screen may be efficiently lowered to several display locations depending upon the viewing angle desired. Much of the operating system is contained in a compact area of a plenum chamber above a ceiling grid. When in the up position, space in an area such as a conference room is conserved. The lower cover 12 is designed to blend in with the ceiling grid 15 for a pleasing appearance and security purposes. The system may be efficiently operated via the remote or wall switch 70.

While a particular system and method have been shown and described, it is intended in this specification to additionally cover all equivalent systems and methods which would reasonably occur to those of skill in the art.

We claim:

1. A securing and operating system for a flat panel display screen(10) having a lower cover element(12) attached thereto, said flat panel display screen(10), when in an up or secure position, being located within a plenum chamber(30) above a ceiling grid(15), operating means for moving said flat panel display screen (10) to one of several lower viewing positions, said operating means comprising a shaft(20) which is driven by a chain and sprocket assembly(25,22), said chain and sprocket assembly being driven by a gear motor(40) and operated by an electronic control box (50), said control box(50) being remotely operated via switch means(70), system operating means whereby said flat panel display screen(10) may be lowered to a first viewing position (10*a*), to a second viewing position(10*b*) or to a third viewing position(10*c*) and returned to an upper secure position.

2. The securing and operating system of claim 1 and further including line means(55) extending between said shaft(20) and said control box(50) to feed back the shaft position to said control box and control the position of the display screen.

3. The securing and operating system of claim 2 wherein a limit switch(60) means is mounted on said display screen and is attached to the control box(50) via a line(65) to shut off power to the unit when the display screen is moved back to the up and secured position within the plenum(30).

4. The securing and operating system of claim 3 and further including speaker means(11) mounted upon the flat display panel(10) for movement therewith.

5. The system of claim 1 wherein said gear motor(40) and said control box(50) are located within said plenum chamber (30).

* * * * *